US010508447B2

(12) United States Patent
Mathews et al.

(10) Patent No.: US 10,508,447 B2
(45) Date of Patent: Dec. 17, 2019

(54) SEALING COVER FOR CONCRETE ANCHOR

(71) Applicant: PRECISION-HAYES INTERNATIONAL INC., Seagoville, TX (US)

(72) Inventors: Thomas Mathews, Midlothian, TX (US); Paul Hohensee, West Bend, WI (US); Tim Beaver, Sugar Land, TX (US); Norris Hayes, Katy, TX (US); Ryan Kitching, Menomonee Falls, WI (US)

(73) Assignee: PRECISION-HAYES INTERNATIONAL INC., Seagoville, TX (US)

( * ) Notice: Subject to any disclaimer, the term of this patent is extended or adjusted under 35 U.S.C. 154(b) by 0 days.

(21) Appl. No.: 15/965,188

(22) Filed: Apr. 27, 2018

(65) Prior Publication Data

US 2018/0313086 A1 Nov. 1, 2018

Related U.S. Application Data

(60) Provisional application No. 62/491,725, filed on Apr. 28, 2017.

(51) Int. Cl.
*E04C 5/12* (2006.01)

(52) U.S. Cl.
CPC ..... *E04C 5/122* (2013.01)

(58) Field of Classification Search
CPC . E04C 5/122; E04C 5/12; E04C 5/161; E04C 5/125; E04C 5/08; E04G 21/12; Y10T 24/3909
See application file for complete search history.

(56) References Cited

U.S. PATENT DOCUMENTS 1,832,940 A * 11/1931 Matthes ..... F16G 11/05 174/84 S
3,766,609 A * 10/1973 Brandestini ..... E04C 5/122 24/115 R
3,956,797 A * 5/1976 Brandestini ..... E04C 5/122 52/223.13
4,343,122 A * 8/1982 Wlodkowski ..... E04C 5/122 52/223.13
4,363,462 A * 12/1982 Wlodkowski ..... E04C 5/12 24/115 M
4,615,640 A * 10/1986 Hosokawa ..... F16D 1/094 403/369
4,719,658 A * 1/1988 Kriofske ..... E04C 5/122 52/223.13
4,773,198 A * 9/1988 Reinhardt ..... E04C 5/122 52/223.13

(Continued)

*Primary Examiner* — Kyle J. Walraed-Sullivan
(74) *Attorney, Agent, or Firm* — Adolph Locklar

(57) ABSTRACT

A cover is provided for sealing a concrete anchor including a flange and a bore extending through the flange. The bore defines an axis and the flange has a first side and a second side. The cover includes a first cover portion for covering a portion of the anchor proximate the first side of the flange, a second cover portion for covering a portion of the anchor proximate the second side of the flange, and a latch coupling the first cover portion and the second cover portion together with the anchor disposed between the latch.

27 Claims, 9 Drawing Sheets

(56) References Cited

U.S. PATENT DOCUMENTS 4,821,474 A * 4/1989 Rodriguez ..... E04C 5/12 24/122.6
4,896,470 A * 1/1990 Sorkin ..... B29C 45/14 52/223.13
4,918,887 A * 4/1990 Davis ..... E04C 5/122 52/223.13
5,024,032 A * 6/1991 Rodriguez ..... E04C 5/12 24/122.6
5,072,558 A * 12/1991 Sorkin ..... B29C 45/14 52/223.13
5,271,199 A * 12/1993 Northern ..... E04C 5/12 24/122.6
5,345,742 A * 9/1994 Rogowsky ..... E04C 5/12 29/452
5,440,842 A * 8/1995 Sorkin ..... E04C 5/12 52/223.13
5,630,301 A * 5/1997 Sieg ..... E04C 5/122 24/115 M
5,695,297 A * 12/1997 Geib ..... F16B 7/149 403/369
5,749,185 A * 5/1998 Sorkin ..... E04C 5/12 24/122.6
5,755,065 A * 5/1998 Sorkin ..... E04C 5/12 52/223.13
5,897,102 A * 4/1999 Sorkin ..... E04C 5/12 249/43
6,017,165 A * 1/2000 Sorkin ..... E04C 5/122 403/371
6,023,894 A * 2/2000 Sorkin ..... E04C 5/122 24/122.6
6,027,278 A * 2/2000 Sorkin ..... E04C 5/122 403/371
6,085,478 A * 7/2000 Workman ..... B65D 59/06 52/301
6,354,596 B1 * 3/2002 Rodriguez ..... E04C 5/12 174/153 G
6,381,912 B1 * 5/2002 Sorkin ..... E04C 5/08 24/459
6,631,596 B1 * 10/2003 Sorkin ..... E04C 5/12 24/122.6
6,761,002 B1 * 7/2004 Sorkin ..... E04C 5/12 403/374.1
6,817,148 B1 * 11/2004 Sorkin ..... E04C 5/12 24/122.6
7,174,685 B2 * 2/2007 Hayes ..... E04C 5/12 52/223.6
7,424,792 B1 * 9/2008 Sorkin ..... E04C 5/122 52/223.13
7,676,997 B1 * 3/2010 Sorkin ..... E04C 5/12 52/223.13
7,797,895 B1 * 9/2010 Sorkin ..... E04C 5/122 403/314
7,823,345 B1 * 11/2010 Sorkin ..... E04C 5/122 24/122.3
7,841,140 B1 * 11/2010 Sorkin ..... E04C 5/10 403/314
7,963,078 B1 * 6/2011 Sorkin ..... E04C 5/122 24/122.3
7,967,532 B2 * 6/2011 Schmidt ..... E02D 5/805 405/259.1
8,087,204 B1 * 1/2012 Sorkin ..... E04C 5/122 52/223.13
9,097,014 B1 * 8/2015 Sorkin ..... E04C 5/122
2002/0007604 A1 * 1/2002 Wallstein ..... E04C 5/122 52/223.13
2002/0112426 A1 * 8/2002 Workman ..... E04C 5/02 52/300
2002/0178665 A1 * 12/2002 Campbell ..... E04C 5/08 52/223.13
2004/0062601 A1 * 4/2004 Thompson ..... E04B 1/215 403/403
2014/0245678 A1 * 9/2014 Mathews ..... E04C 5/122 52/223.13
2015/0330078 A1 * 11/2015 Sorkin ..... E04B 1/66 52/223.13
2017/0016233 A1 * 1/2017 Sorkin ..... E04C 5/122
2017/0037625 A1 * 2/2017 Sorkin ..... E04C 5/122
2017/0037626 A1 * 2/2017 Sorkin ..... E04C 5/122
2018/0023298 A1 * 1/2018 Hayes ..... E04G 21/12 52/223.13

* cited by examiner

SEALING COVER FOR CONCRETE ANCHOR

CROSS-REFERENCE TO RELATED APPLICATIONS

This application claims the benefit of prior-filed, U.S. Provisional Patent Application No. 62/491,725, filed Apr. 28, 2017, the entire contents of which are incorporated by reference herein.

FIELD

The present application relates to anchors for reinforced concrete, and particularly to a sealing cover for an anchor of a concrete reinforcement system.

BACKGROUND

Concrete is capable of withstanding significant compressive loads, but is more susceptible to failure when subjected to tensile loads. Thus, concrete structures are often reinforced with steel bars, cables, or similar to enhance the structure's ability to withstand tensile forces.

SUMMARY

In one aspect, a cover is provided for sealing a concrete anchor including a flange and a bore extending through the flange. The bore defines an axis and the flange has a first side and a second side. The cover includes a first cover portion for covering a portion of the anchor proximate the first side of the flange, a second cover portion for covering a portion of the anchor proximate the second side of the flange, and a latch for coupling the first cover portion and the second cover portion together with the anchor disposed between the latch.

In another aspect, a cover is provided for sealing a concrete anchor including a flange and a bore extending through the flange. The bore defines an axis and the flange has a first side and a second side. The cover includes a first cover portion for covering a portion of the anchor proximate the first side of the flange, a second cover portion for covering a portion of the anchor proximate the second side of the flange, and at least one latch for releasably coupling the first cover portion to the second cover portion.

In yet another aspect, a concrete anchor is provided and includes a flange having a first side and a second side, and a bore extending through the flange. The bore defines an axis. The anchor further includes a first cover portion for covering a portion of the anchor proximate the first side of the flange, a second cover portion for covering a portion of the anchor proximate the second side of the flange, and a latch for selectively maintaining the cover and the anchor together.

Independent features and independent advantages will become apparent to those skilled in the art upon review of the detailed description, drawings, and claims.

DETAILED DESCRIPTION

Before any independent embodiments are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

The use of "including", "comprising", or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass both direct and indirect mountings, connections, supports, and couplings. Further, "connected" and "coupled" are not restricted to physical or mechanical connections or couplings.

Figure 1:
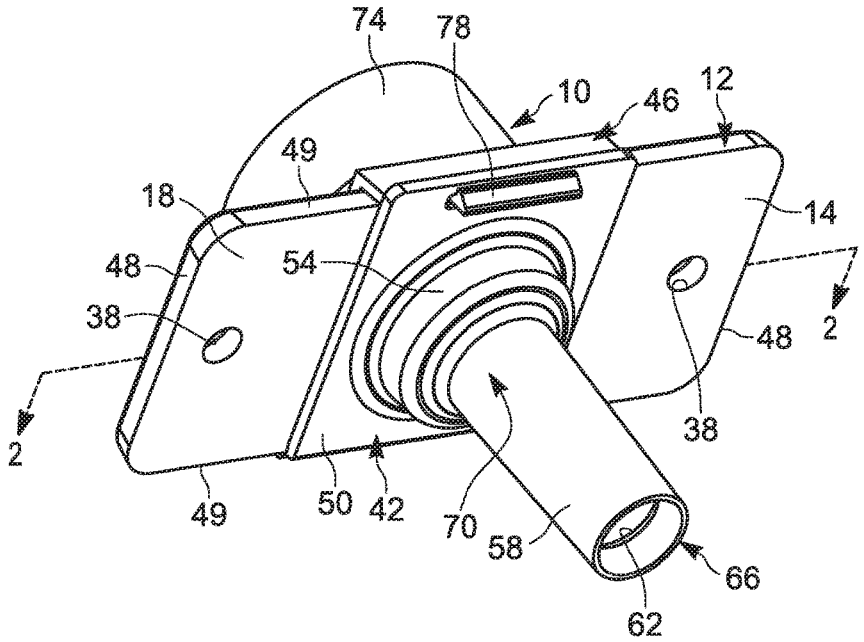
FIG. 1 is a perspective view of an anchor and a sealing cover.
Figure 2:
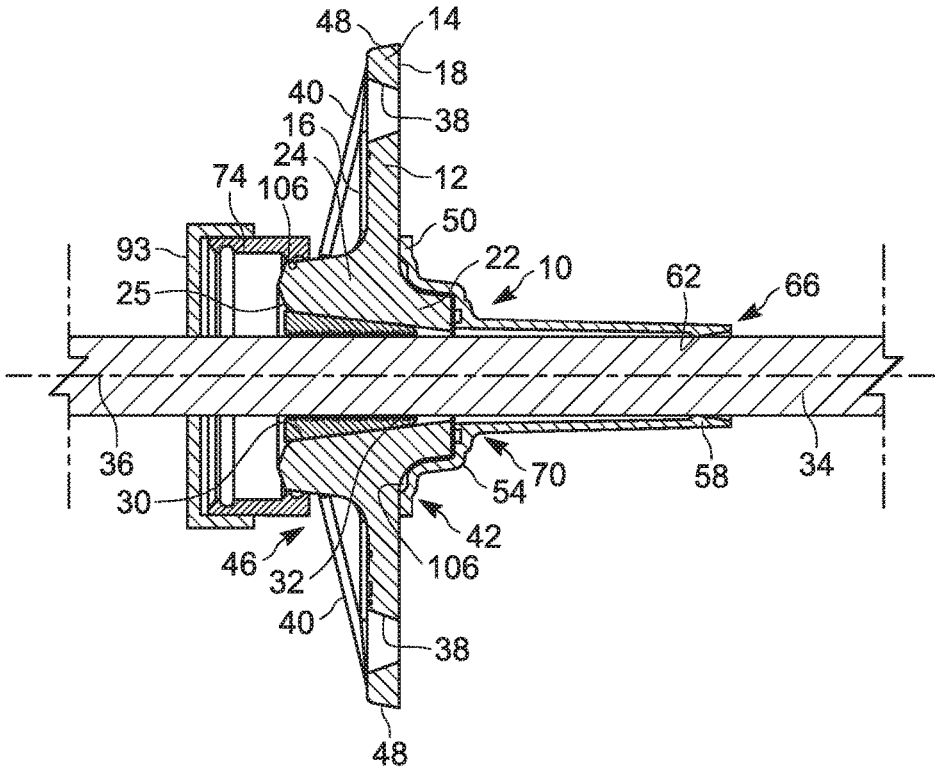
FIG. 2 is a cross-sectional view of the sealing cover and the anchor of FIG. 1, viewed along section 2-2.

FIGS. 1 and 2 illustrate a sealing device or cover 10 for an anchor 12. The anchor 12 of the illustrated embodiment secures a tensioned cable or tendon 34 (FIG. 2) for reinforcing a concrete slab. The anchor 12 includes a body including a flange portion 14 having a front surface 16 and a rear surface 18. The rear surface 18 provides a bearing surface abutting a portion of the concrete slab (not shown) while tension is applied to the tendon 34. In the illustrated embodiment, the body also includes a button portion 22 that extends from the rear surface 18 of the flange 14 and a nose portion 24 that extends from the front surface 16 of the flange 14. The nose portion 24 may include a seating surface 25 (e.g., for engaging a hydraulic jack tensioner (not shown) during tensioning of the tendon 34). In the illustrated embodiment, the anchor 12 is formed as a unitary component via casting, forging, or other suitable process. The anchor 12 can be formed from a metallic material, such as cast steel or ductile iron.

As shown in FIGS. 1 and 2, the flange 14 may have a rectangular shape, and the button portion 22 and the nose portion 24 may both be centered on the flange 14. The flange 14 extends laterally from the nose portion 24 and the button portion 22 to opposite distal edges 48 on the lateral sides of the nose portion 24 and the button portion 22 and to opposite proximal edges 49 on the vertical sides of the nose portion 24 and the button portion 22. In the illustrated embodiment, the anchor 10 also includes ribs 40 (FIG. 2) extending between the nose portion 24 and the front surface 16 of the flange portion 14.

Referring to FIG. 2, the anchor 12 includes a wedge cavity or bore 30 that extends through the nose portion 24, the flange portion 14, and the button portion 22. The tendon 34 extends through the bore 30. The bore 30 extends along a bore axis 36, and the bore 30 is tapered along the axis 36 from the nose portion 24 to the button portion 22. That is, a diameter of the bore 30 proximate the nose portion 24 is larger than the diameter proximate the button portion 22. The bore 30 receives two wedge members 32, each of which has an outer surface that abuts against the tapered bore 30 and an inner surface that engages or clamps onto an outer surface of the tendon 34. The wedge members 32 are positioned between the outer surface of the tendon 34 and the tapered bore 30, thereby securing the tendon 34 relative to the anchor 12.

In the illustrated embodiment, the anchor 12 also contains holes 38 extending through the flange portion 14. Two holes 38 are shown in FIGS. 1 and 2, but other embodiments may include fewer or more holes 38. The holes 38 may receive a fastener for securing the anchor 10 to the concrete slab or into a form board (not shown). In other embodiments, the anchor 12 may be free of any mounting holes 38 altogether and may be attached to the concrete slab or form board by other means.

Figure 3:
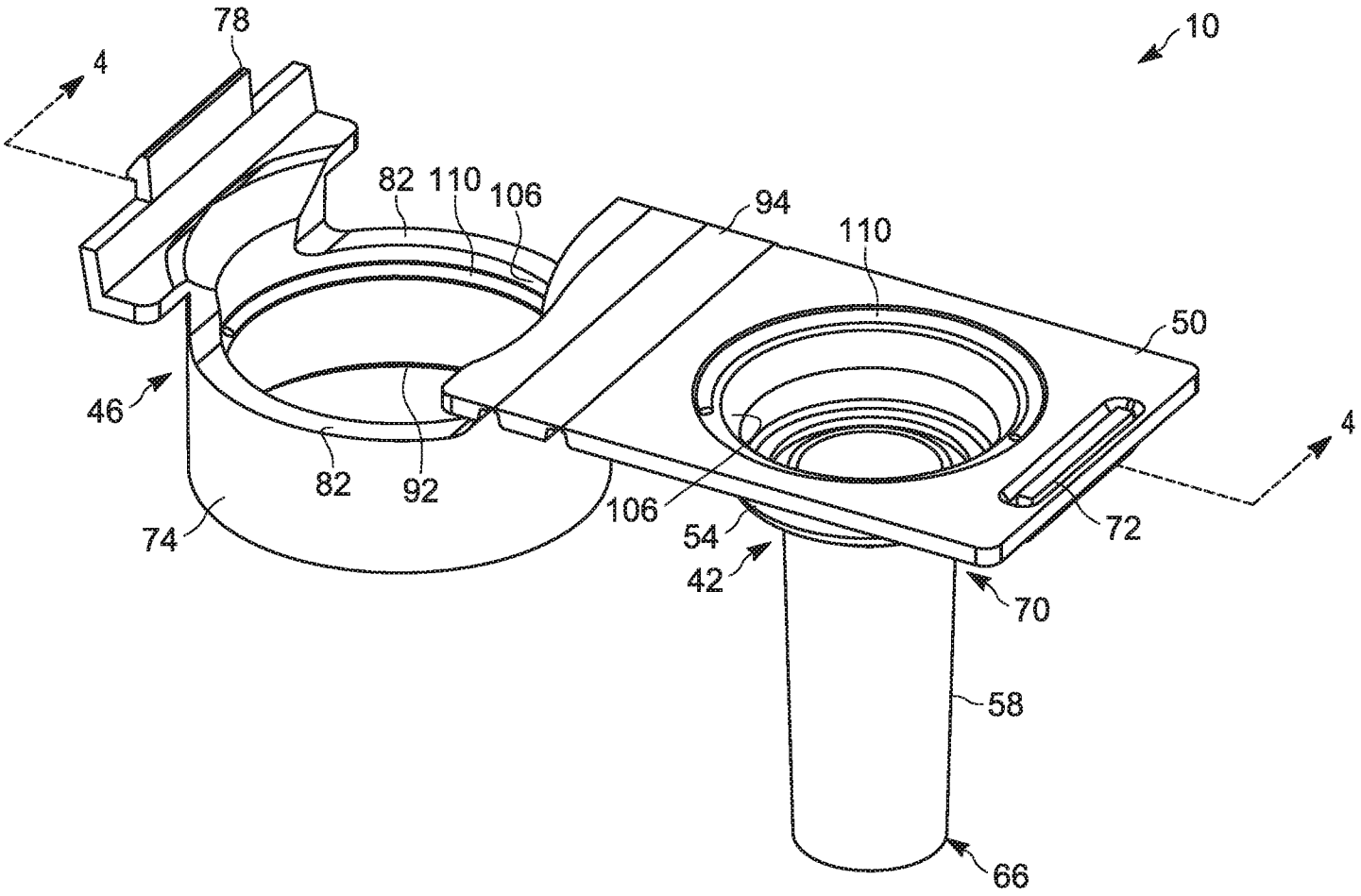
FIG. 3 is a perspective view of the sealing cover of FIG. 1 in a first position.

Referring to FIGS. 1 and 3, the sealing cover 10 is coupled to the concrete anchor 12 to seal at least a portion of the anchor 12 from the concrete and liquids/additives entrained within the concrete, thereby inhibiting corrosion of the anchor 12. In the illustrated embodiment, the sealing cover 10 encapsulates and seals the button portion 22, the nose portion 24, the bore 30, and the wedge members 32, preventing these portions from being exposed to the concrete and liquids/additives therein. The cover 10 of the illustrated embodiment is formed as a unitary component via a single casting, molding, or other suitable process. The sealing cover 10 is preferably formed of plastic (e.g., nylon, polyethylene, ABS, PVC, etc.).

As shown in FIG. 3, the sealing cover 10 generally includes a first cover portion or button-side cover 42 and a second cover portion or nose-side cover 46 pivotably coupled to the button-side cover 42. The button-side cover 42 includes a planar portion 50, a button housing 54 extending away from the planar portion 50, and a tube 58 extending away from the button housing 54. The button housing 54 covers the button portion 22 (FIG. 2) of the anchor 12 while the tube 58 encloses a portion of the tendon 34 extending from the button portion 22 of the anchor 12. The tube 58 includes an annular ridge 62 (FIG. 2) extending radially inward toward the tendon 34. The annular ridge 62 contacts the tendon 34 or an intermediate tendon sheath (not shown) to inhibit concrete and liquid/additives therein from contacting the tendon 34. The annular ridge 62 may be positioned at a distal end 66 of the tube 58 opposite a connecting end 70 adjacent the button housing 54. The button-side cover 42 further includes an elongated slot 72 formed through the planar portion 50 for selectively receiving a portion of the nose-side cover 46, as described in more detail below.

Figure 4:
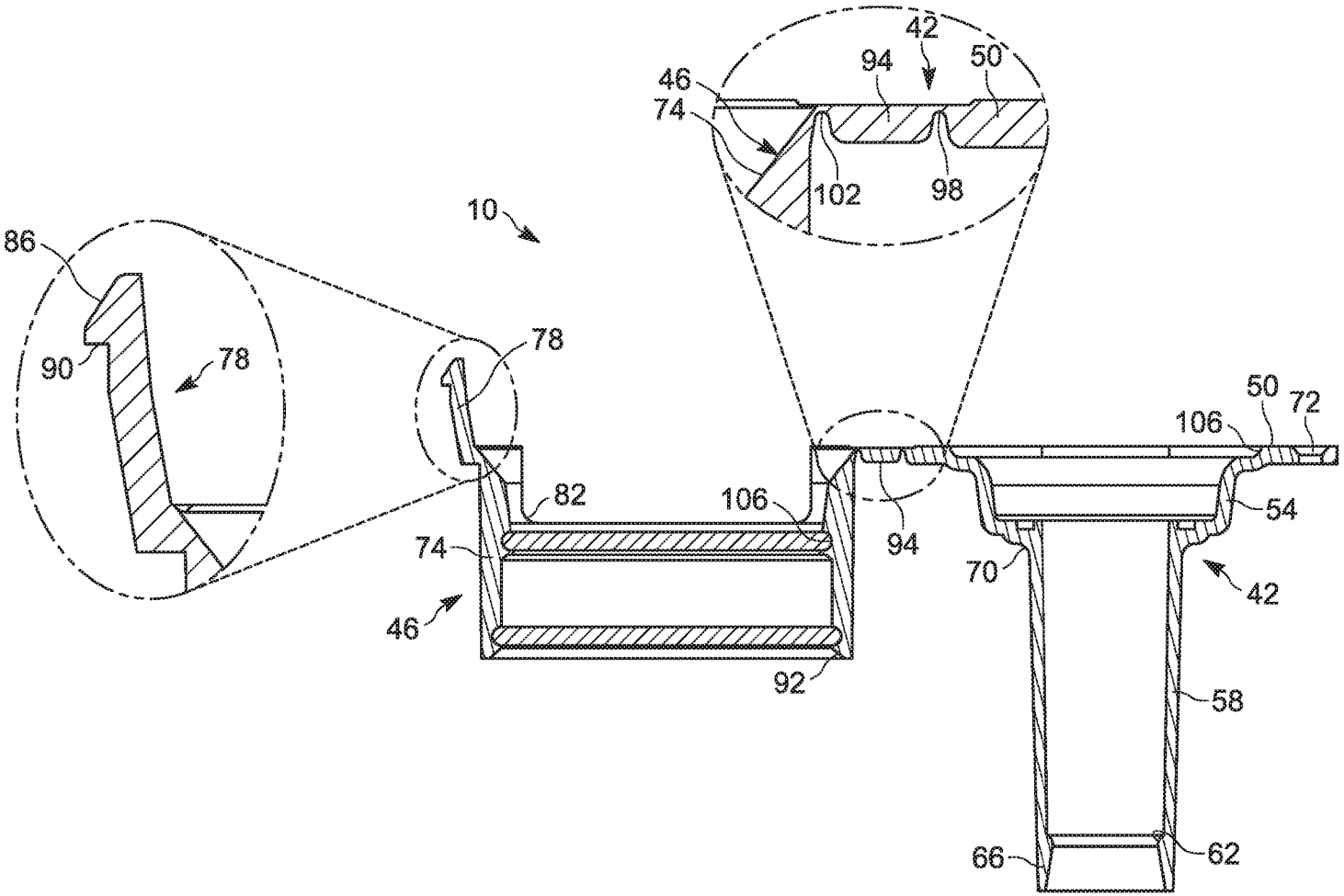
FIG. 4 is a cross-sectional view of the sealing cover of FIG. 3, viewed along section 4-4.

Referring again to FIG. 3, the nose-side cover 46 includes a nose housing 74 and a latch 78. The nose-side cover 46 is formed as a cylinder to cover the nose portion 24. The nose-side cover 46 may include cutouts 82 to avoid interfering with the ribs 40 of the anchor 12 when the sealing cover 10 is coupled to the anchor 12. The latch 78 is a hook-type latch that is engageable with the elongated slot 72 of the button-side cover 42 via an interference fit. As shown in FIG. 4, the latch 78 includes a cam surface 86 and a shoulder 90. The latch 78 elastically deflects from a first position (as shown in FIGS. 3 and 4) toward a second position (e.g., radially inwardly) when a sufficient force acts on the cam surface 86 as a result of the cam surface 86 contacting an edge of the elongated slot 72. Once the latch 78 is inserted a proper distance through the elongated slot 72, the latch 78 returns toward the first position until the shoulder 90 extends entirely through the slot 72 and rests against the planar portion 50.

Referring again to FIG. 3, the nose housing 74 further includes an aperture 92 allowing access to the anchor 12 during installation periods. The aperture 92 is appropriately shaped so the seating surface 25 of the nose portion 24 can be engaged by a hydraulic jack tensioner during the tensioning of the tendon 34. Once tensioning is complete, the aperture 92 may be closed via a removable cap 93 (FIG. 2), or an intermediate tendon coupler may be positioned adjacent the nose portion 24. In the illustrated embodiment, the cap 93 is a grease-cap. In other embodiments, the cap 93 may be another type of cap or closure member.

As shown in FIG. 4, the sealing cover 10 further includes a hinge disposed between and interconnecting the button-side cover 42 and the nose-side cover 46. The hinge includes two thin zone joints 98, 102 (sometimes referred to as a living hinge) that enable the button-side and nose-side covers 42, 46 to move relative to each other. A first thin zone joint 98 is disposed between a hinge member 94 and the button-side cover 42, thereby allowing the button-side cover 42 to pivot relative to the hinge member 94. A second thin zone joint 102 is disposed between the hinge member 94 and the nose-side cover 46, thereby allowing the hinge member 94 to pivot relative to the nose-side cover 46. As such, the button-side cover 42 is moveable relative to the nose-side cover 46 between a first position (as shown in FIG. 3) and a second position (as shown in FIG. 1). In the first position, the button-side cover 42 is released from the nose-side cover 46 in order to receive the anchor 12. In the second position, the button-side cover 42 and the nose-side cover 46 are coupled together via the latch 78 and slot 72 arrangement, thereby encapsulating portions of the anchor 12.

Referring to FIGS. 2-4, in the illustrated embodiment, the sealing cover 10 further includes grooves 106 for receiving a sealing member 110 (e.g., an adhesive, sealant, O-ring, etc.) to provide a bond and seal between the sealing cover 10 and the anchor 12 (FIG. 3). When the sealing cover 10 is in the first position, the sealing member 110 bonds the anchor 12 and sealing cover 10 together to provide a liquid-tight seal between the sealing cover 10 and the anchor 12. As a result, the sealing cover 10 provides corrosion protection for the encapsulated portions of the anchor 12 (e.g., the button portion 22, the nose portion 24, the bore 30, and the wedge member 32).

During assembly, the nose portion 24 is positioned within the nose-side cover 46 while the sealing cover 10 is in the second position. The button-side cover 42 is pivoted about the hinge and the nose-side cover 46 until the sealing cover 10 is in the first position and the latch 78 engages the elongated slot 72. The sealing member 110 forms a liquid-tight seal between the sealing cover 10 and the anchor 12. The tendon 34 passes through the tube 58 of the button-side cover 42, the bore 30 of the anchor 12, and through the nose housing 74 of the nose-side cover 46. The anchor 12 may be secured against a concrete slab or form board (e.g., by passing fasteners through the holes 38) and the tendon 34 (FIG. 2). The tendon 34 (FIG. 2) is tensioned and the wedge members 32 are positioned in the bore 30 to secure the tendon 34 relative to the anchor 12.

In the illustrated embodiment, the sealing cover 10 provides corrosion-protection primarily for the wedge cavity 30, with the lateral edge portions of the flange portion 14 being uncovered. The cover 10 may therefore protect at least the critical anchorage zone of the assembly against corrosion or deterioration caused by chemical interactions between the metallic anchor 12 and the water or additives in the concrete. In some embodiments, the edge portions of the anchor 12 are permitted to patina naturally. The sealing cover 10 can be economically manufactured as a separate piece from the anchor 12 via a molding process, thereby avoiding an expensive process of insert molding a cover around the anchor 12. The sealing cover 10 may be coupled to conventional anchors.

Figure 5:
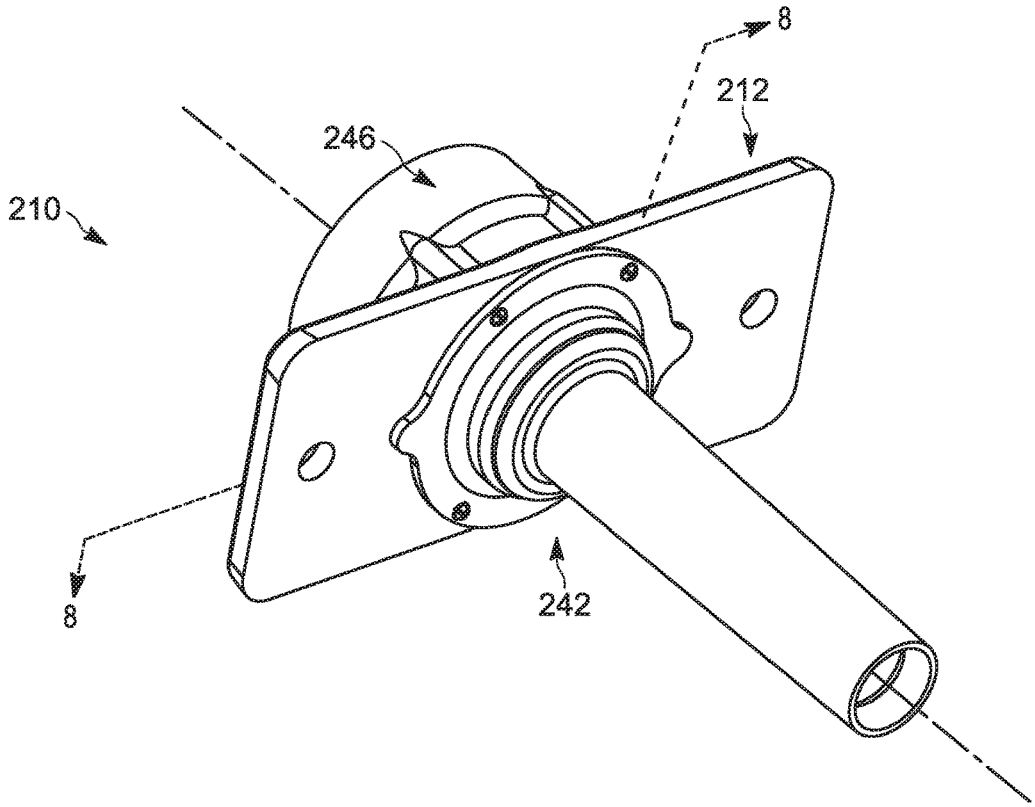
FIG. 5 is a perspective view of an anchor and a sealing cover according to another embodiment.
Figure 6:
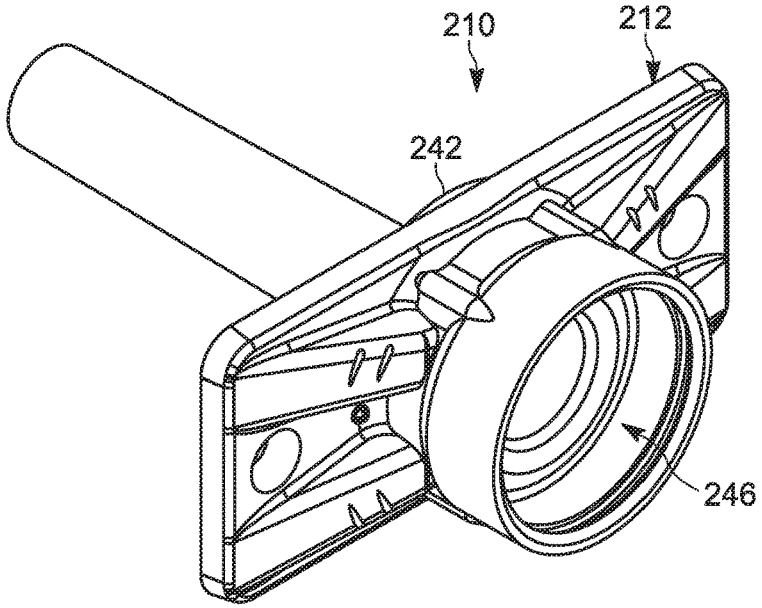
FIG. 6 is a reverse perspective view of the anchor and sealing cover of FIG. 5.
Figure 7:
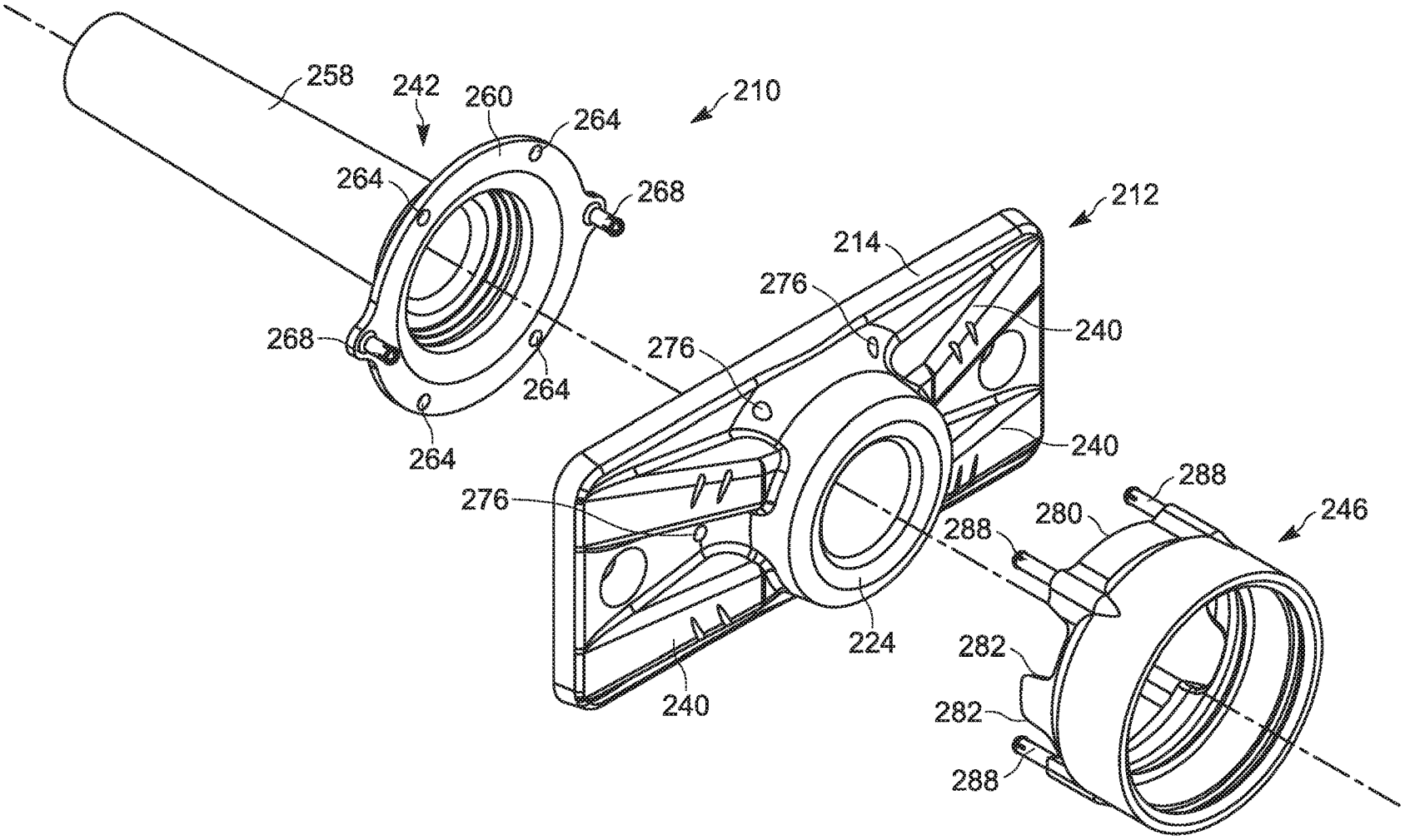
FIG. 7 is an exploded view of the anchor and sealing cover of FIG. 5.
Figure 8:
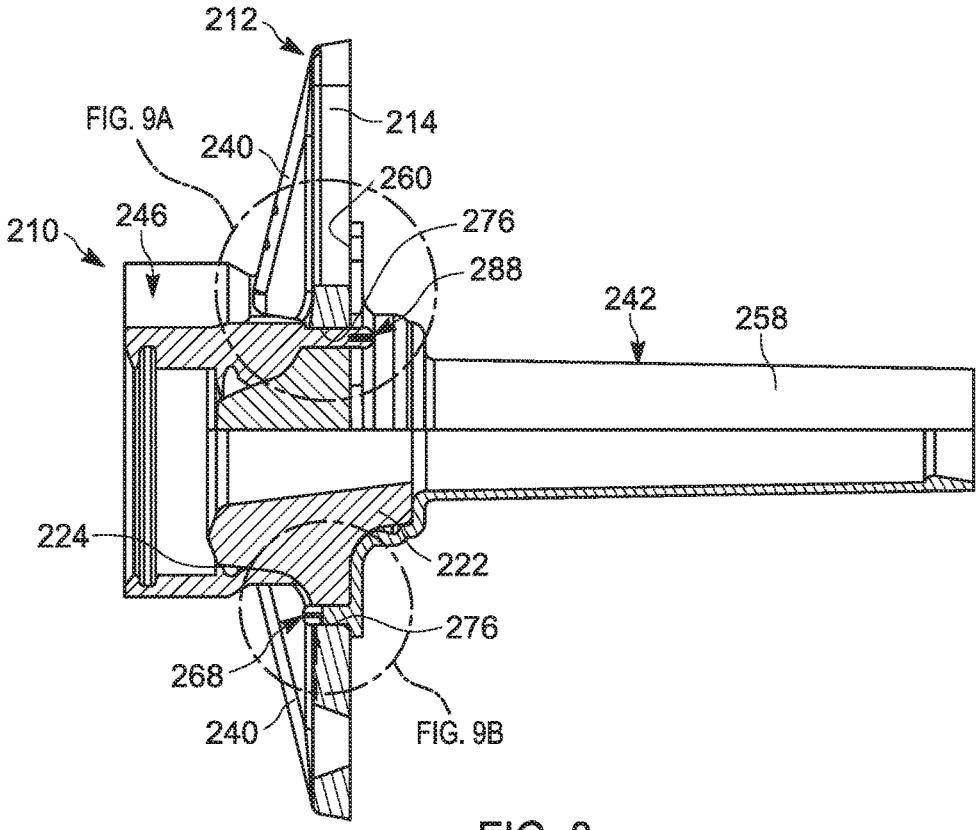
FIG. 8 is a cross-sectional view of the anchor and cover of FIG. 5, viewed along section 8-8.

FIGS. 5-9 illustrate a sealing cover 210 according to another embodiment. As shown in FIGS. 5-7, the cover 210 includes a first cover portion or button-side cover 242 and a second cover portion or nose-side cover 246. As shown in FIGS. 7 and 8, the button-side cover 242 includes a tube 258 and an end surface 260 abutting a side of the anchor flange 214 adjacent the button portion 222 (FIG. 8). Referring to FIG. 7, the button-side cover 242 further includes holes 264 spaced apart along the perimeter of the end surface and a pair of button cover retainers 268 extending from opposite sides of the end surface 260. In the illustrated embodiment, the button-side cover 242 includes four holes 264 and two button cover retainers 268; in other embodiments, the button-side cover 242 may include fewer or more holes and/or fewer or more button cover retainers. Each hole 264 and each button cover retainer 268 is aligned with an opening 276 extending through the flange 214. In the illustrated embodiment, each button cover retainer 268 extends through an associated opening 276 and secures the button-side cover 242 to the flange 214.

As shown in FIGS. 7-9, the nose-side cover 246 includes an end surface 280 and cutouts 282 positioned along the perimeter of the end surface 280. Each cutout 282 receives a rib 240 of the anchor 12. In addition, the nose-side cover 246 includes four nose cover retainers 288 extending from the end surface 280 of the nose-side cover 246. Each nose cover retainer 288 is aligned with and extends through an associated opening 276 to secure the nose-side cover 246 to the flange 214. In the illustrated embodiment, the nose-side cover 246 includes four nose cover retainers 288; in other embodiments, the nose-side cover 246 may include fewer or more nose cover retainers. Referring to FIG. 9, in the illustrated embodiment, each nose cover retainer 288 also extends through an associated hole 264 of the button-side cover 242, thereby securing the nose-side cover 246 to the button-side cover 242.

Figure 9A:
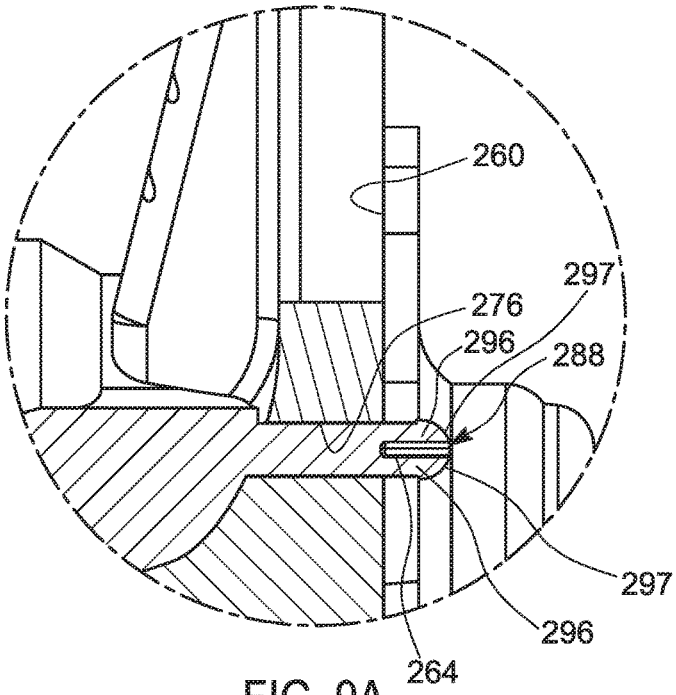
FIG. 9A is an enlarged view of the sealing cover of FIG. 8, viewed within area labeled FIG. 9A.
Figure 9B:
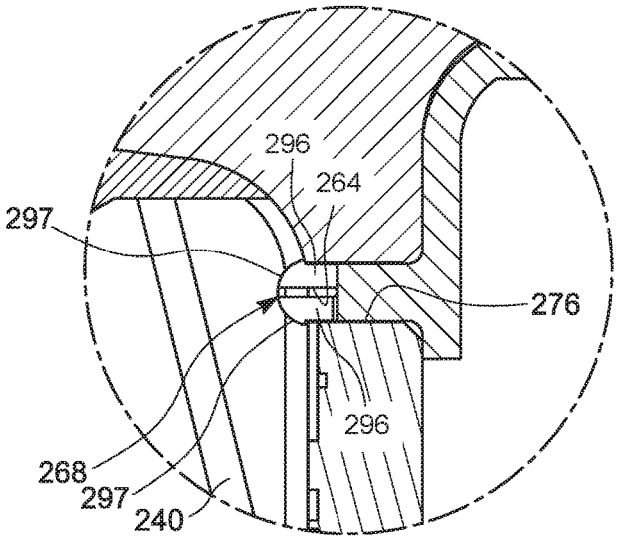
FIG. 9B is an enlarged view of the sealing cover of FIG. 8, viewed within area labeled FIG. 9B.

As best shown in FIGS. 9A and 9B, in the illustrated embodiment, each button cover retainer 268 (FIG. 9B) and each nose cover retainer 288 (FIG. 9A) includes a plurality of cantilevered portions 296, and each cantilevered portion has a hook 297. As the retainers 268, 288 are inserted into their respective openings 276 in the anchor 12, the cantilevered portions 296 deflect inwardly. Once the hooks 297 protrude from the opposite side the cantilevered portions 296 deflect outwardly, forming a snap-fit connection. In other embodiments, the retainers 268, 288 may have a different structure, and/or the button-side cover 242 and the nose-side cover 246 may be retained in a different manner.

Figure 10:
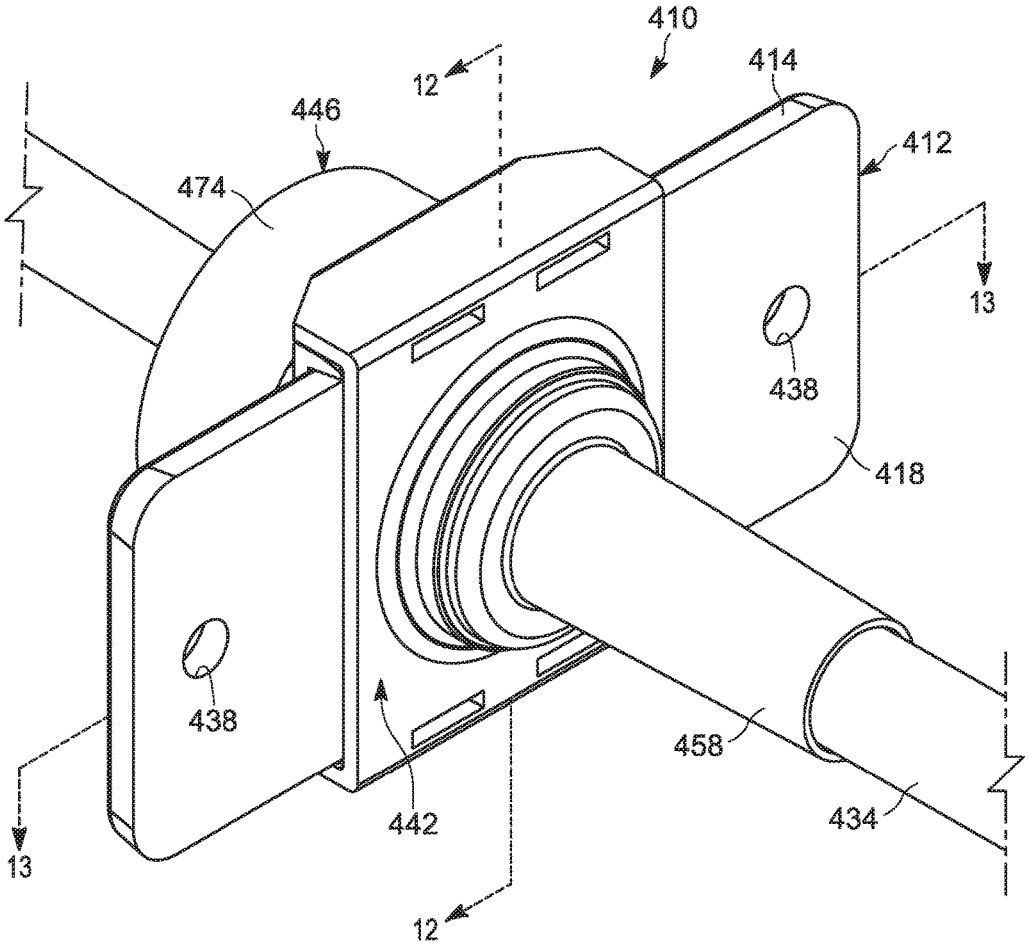
FIG. 10 is a perspective view of an anchor and a sealing cover according to another embodiment.
Figure 11:
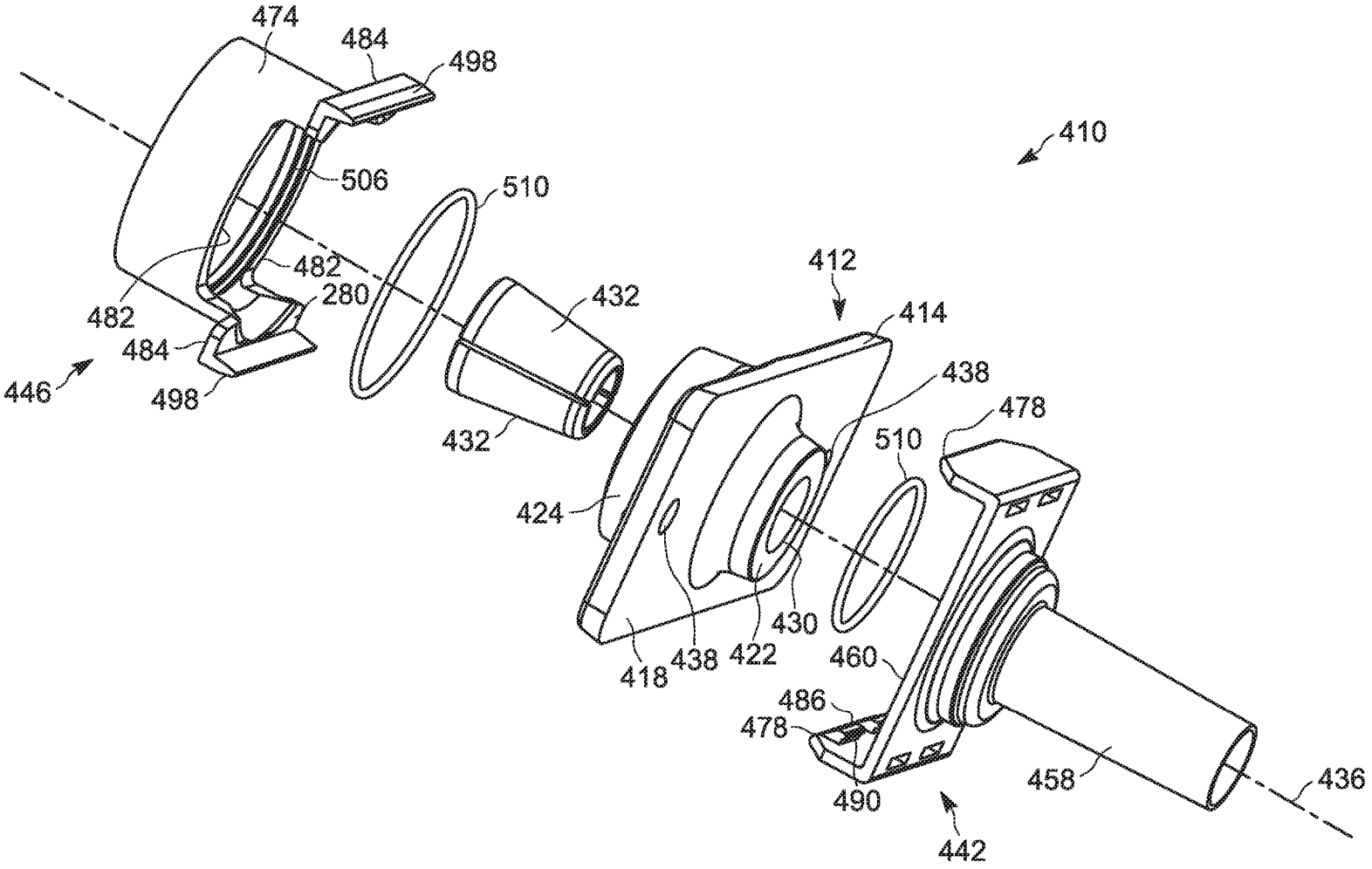
FIG. 11 is an exploded view of the anchor and sealing cover of FIG. 10 and wedge members.

FIGS. 10-13 illustrate a sealing device or cover 410 for an anchor 412 according to another embodiment. The anchor 412 secures a tensioned cable or tendon 434. The anchor 412 includes a body including a flange portion 414 having a front surface 416 and a rear surface 418. The rear surface 418 provides a bearing surface abutting a portion of the concrete slab (not shown) while tension is applied to the tendon 434. As shown in FIG. 11, the body also includes a button portion 422 that extends from the rear surface 418 of the flange 414 and a nose portion 424 that extends from the front surface 416 of the flange 414. As shown in FIGS. 10 and 11, the flange 414 may have a rectangular shape, and the button portion 422 and the nose portion 424 may both be centered on the flange 414. The anchor 410 also includes ribs 440 (FIG. 13) extending between the nose portion 424 and the front surface 416 of the flange portion 414.

Figure 12:
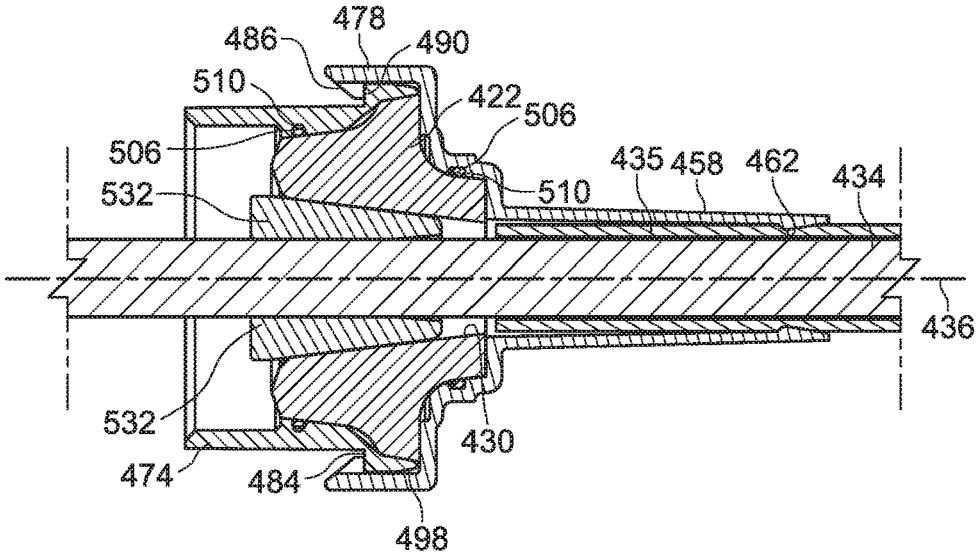
FIG. 12 is cross-sectional view of the anchor and cover of FIG. 10, viewed along section 12-12, with wedges securing a tendon.
Figure 13:
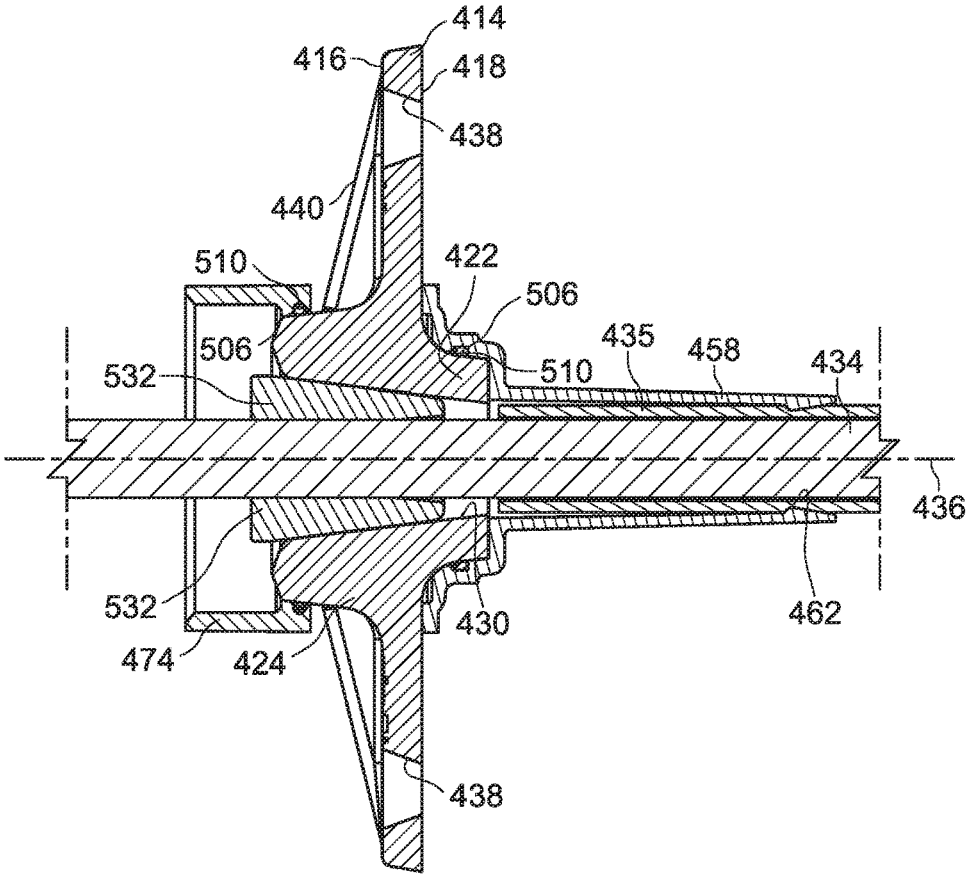
FIG. 13 is cross-sectional view of the anchor and cover of FIG. 10, viewed along section 13-13, with wedges securing the tendon.

Referring to FIG. 11, the anchor 412 includes a wedge cavity or bore 430 that extends through the nose portion 424, the flange portion 414, and the button portion 422. As shown in FIG. 12, the tendon 434 extends through the bore 430. The bore 430 extends along a bore axis 436, and the bore 430 is tapered along the axis 436 from the nose portion 424 to the button portion 422. That is, a diameter of the bore 430 proximate the nose portion 424 is larger than the diameter proximate the button portion 422. In the illustrated embodiment, the bore 430 receives two wedge members 432, and each of the wedge members has an outer surface that abuts against the tapered bore 430 and an inner surface that engages or clamps onto an outer surface of the tendon 434. The wedge members 432 are positioned between the outer surface of the tendon 434 and the tapered bore 430, thereby securing the tendon 434 relative to the anchor 412.

In the illustrated embodiment, the anchor 412 also contains holes 438 extending through the flange portion 414. The holes 438 may receive a fastener for securing the anchor 410 to the concrete slab or into a form member (not shown). In other embodiments, the anchor 412 may include fewer or more than two holes 438, or may be free of any mounting holes 438 altogether and may be coupled to the concrete slab or form member by other means.

As shown in FIGS. 10-13, the cover 410 includes a first or button-side cover 442 and a second or nose-side cover 446. As shown in FIG. 11, the button-side cover 442 includes a tube 458 and a planar portion 450 abutting the second side 418 of the anchor flange 414 adjacent the button portion 422. The button-side cover 442 covers the button portion 422 of the anchor 412 while the tube 458 encloses a portion of the tendon 434 extending from the button portion 422 of the anchor 412. The tube 458 includes an annular ridge 462 (FIG. 12) extending radially inward toward the tendon 434. The annular ridge 462 contacts the tendon 434 or an intermediate tendon sheath 435 to inhibit concrete and liquid/additives therein from contacting the tendon 434.

The button-side cover 442 further includes first and second latches 478 extending away from the planar portion 450 in a direction parallel to the axis 436. The latches 478 are hook-type latches that are engageable with the nose-side cover 446 via an interference fit, as described in further detail below. As shown in FIGS. 11 and 12, each latch 478 includes a cam surface 486 and a shoulder 490. Each latch 478 elastically deflects from a first position (as shown in FIGS. 11 and 12) to a second position (e.g., radially outward) when a sufficient force acts on the cam surface 486 as a result of the cam surface 486 contacting an edge of the nose-side cover 446.

As shown in FIGS. 10-13, the nose-side cover 446 includes a nose housing 474 that is formed as a cylinder to cover the nose portion 424. The nose-side cover 446 includes an end surface 280 and cutouts 482 positioned along the perimeter of the end surface 480. Each cutout 482 receives a rib 440 of the anchor 412. In addition, the nose-side cover 246 includes latch-engaging features (e.g., shoulders 484) and cam surfaces 498. The shoulders 484 and the cam surfaces 498 are configured to interact with the corresponding latches 478 of the button-side cover 442. Specifically, when the latches 478 contact the nose-side cover 446, the cam surfaces 486 of the latches 478 slide against the cam surfaces 498 of the nose-side cover 446 forcing the latches 478 to rotate radially outward. Once the latches 478 slide against the nose-side cover 446 a proper distance, the latches 478 returns toward the first position where the shoulders 490 of the latches 478 mate with the corresponding shoulders 484 of the nose-side cover 446, thereby locking the button-side cover 442 to the nose-side cover 446.

In the illustrated embodiment, each latch 478 is formed on the button-side cover 442 and each latch-engaging feature or shoulder 484 is formed on the nose-side cover 446. It is understood that other constructions may include one or both latches formed on the nose-side cover 446 and one or both latch-engaging features/shoulders formed on the button-side cover 442.

The sealing cover 410 further includes grooves 506 for receiving a sealing member 510 (e.g., an O-ring) to provide a bond and seal between the sealing cover 410 and the anchor 412 (FIG. 11). When the nose-side cover 446 is coupled to the button-side cover 442, the sealing member 510 provides a liquid-tight seal between the sealing cover 410 and the anchor 412. As a result, the sealing cover 410 provides corrosion protection for the encapsulated portions of the anchor 412 (e.g., the button portion 422, the nose portion 424, the bore 430, and the wedge member 432).

During assembly, the nose portion 424 is positioned within the nose-side cover 446 while button-side cover 442 is spaced away from the button portion 422. The button-side cover 442 is moved along the axis 436 until the latches 478 engage the shoulders 484. The tendon 434 passes through the tube 458 of the button-side cover 442, the bore 430 of the anchor 412, and through the nose housing 474 of the nose-side cover 446. The anchor 412 may be secured against a concrete slab or form board (e.g., by passing fasteners through the holes 438) and the tendon 434. The tendon 434 is tensioned and the wedge members 432 are positioned in the bore 430 to secure the tendon 434 relative to the anchor 412.

In the illustrated embodiment, the sealing cover 410 provides corrosion-protection primarily for the wedge cavity 430, with the lateral edge portions of the flange portion 414 being uncovered. The cover 410 may therefore provide protection for at least a portion of the anchorage zone of the assembly against corrosion or deterioration caused by chemical interactions between the metallic anchor 412 and the water or additives in the concrete. In some embodiments, the edge portions of the anchor 412 are permitted to patina naturally.

The independent embodiments described above and illustrated in the figures are presented by way of example only and are not intended as a limitation upon the concepts and principles of the present invention. As such, it will be appreciated that various changes in the elements and their configuration and arrangement are possible without departing from the spirit and scope of the present invention. One or more independent advantages and/or independent features of the invention may be set forth in the claims.

What is claimed is:

1. A cover for sealing a concrete anchor, the concrete anchor including a flange, a nose portion, a button portion, and a bore extending through the flange, the bore defining an axis and the flange having a button side and a nose side, the cover comprising:

a button-side cover portion configured to cover the button portion of the concrete anchor;

a nose-side cover portion configured to cover the nose portion of the concrete anchor; and at least one latch for coupling the button-side cover portion to the nose-side cover portion with the flange disposed between the button-side cover portion and the nose-side cover portion;

wherein the button-side cover portion and the nose-side cover portion are moveable between a first position in which the button-side cover portion is released from the nose-side cover portion so as to receive the concrete anchor therebetween and a second position in which the button-side cover portion and the nose-side cover portion are coupled together via the at least one latch with the concrete anchor therebetween, so as encapsulate the button portion and the nose portion of the concrete anchor; and wherein the button-side cover portion includes a sealing member forming a liquid-tight bond between the button-side cover portion and the portion of the concrete anchor proximate the button side of the flange, wherein the nose-side cover portion includes another sealing member forming a liquid-tight bond between the nose-side cover portion and the portion of the concrete anchor proximate the nose side of the flange.

2. The cover of claim 1, further including a hinge disposed between the button-side cover portion and the nose-side cover portion and wherein the button-side cover portion is pivotably coupled to the nose-side cover portion.

3. The cover of claim 1, wherein the at least one latch is integrally formed with at least one of the button-side and nose-side cover portions.

4. The cover of claim 3, wherein one of the button-side and nose-side cover portions includes a slot for receiving and engaging the at least one latch and wherein the at least one latch further includes a cam surface capable of engaging the other of the button-side and nose-side cover portions to elastically displace the at least one latch from a first position to a second position allowing the slot to receive the at least one latch.

5. The cover of claim 1, wherein the button-side cover portion and the nose-side cover portion are formed as separate components.

6. The cover of claim 5, wherein the cover includes first and second latches and wherein the concrete anchor is captured between the first latch and the second latch.

7. The cover of claim 6, wherein the first latch and the second latch each include a shoulder capable of engaging corresponding shoulders of one of the button-side and nose-side cover portions once the first and second latches move from the second position to the first position, thereby securing the button-side cover portion to the nose-side cover portion.

8. The cover of claim 7, wherein the first latch engages a shoulder of the nose-side cover portion and the second latch engages a shoulder of the nose-side cover portion simultaneously.

9. The cover of claim 1, wherein the button-side cover portion can be latched to the nose-side cover portion by moving the button-side cover portion in a direction parallel to the axis toward the nose-side cover portion.

10. The cover of claim 6 wherein the first latch and the second latch are positioned along opposite edges of the flange.

11. The cover of claim 10, further comprising a first latch-engaging feature and a second latch-engaging feature, the first latch-engaging feature engaging the first latch, the second latch-engaging feature engaging the second latch.

12. The cover of claim 11, further comprising a first cam surface and a second cam surface, the first cam surface capable of elastically displacing the first latch to permit the first latch to engage the first latch-engaging feature, the second cam surface capable of elastically displacing the second latch-engaging latch to permit the second latch to engage the second feature.

13. The cover of claim 5 wherein the at least one latch comprises at least one retainer extending from one of the button-side and nose-side cover portions, wherein the flange includes a hole therethrough, the location of the hole corresponding to the location of the retainer, and wherein the button-side and nose-side cover portions are coupled by passing the at least one retainer through the hole in the flange and engaging the other of the button-side and nose-side cover portions with the at least one retainer.

14. The cover of claim 1 wherein the concrete anchor further includes a nose extending from the nose side and a button extending from the button side and wherein the button-side cover portion includes a button housing and a tube extending away from the button housing, the tube being aligned with the axis.

15. The cover of claim 14 wherein the button housing covers the button of the concrete anchor and the tube is configured to enclose a portion of a tendon extending from the button.

16. The cover of claim 15 wherein the tube includes an annular ridge extending radially inward.

17. The cover of claim 14 wherein the nose-side cover portion includes a nose housing having an aperture therethrough, the aperture being aligned with the axis.

18. The cover of claim 1, further including a removable cap adapted to mechanically engage the nose-side cover portion and to close the aperture when engaged.

19. A cover for sealing a concrete anchor, the concrete anchor including a flange, and a bore extending through the flange, the bore defining an axis and the flange having a first side and a second side, the cover comprising:

a first cover portion configured to cover a portion of the first side of the flange;

a second cover portion configured to cover a portion of the second side of the flange anchor; and at least one latch for coupling the first cover portion to the aft-second cover portion with a portion of the flange disposed between the first and second cover portions;

wherein the first cover portion and second cover portion are moveable between a first position in which the first cover portion is released from the second cover portion so as to receive the concrete anchor therebetween and a second position in which the first cover portion and the second cover portion are coupled together via the at least one latch with the concrete anchor therebetween; and wherein each of the first and second cover portions includes a sealing member forming a liquid-tight bond between the respective cover portion and the portion of the concrete anchor proximate that cover portion.

20. The cover of claim 19 wherein the anchor further includes a nose extending from the second side and a button extending from the first side and wherein the first cover portion includes a button housing and a tube extending away from the button housing, the tube being aligned with the axis.

21. The cover of claim 20 wherein the button housing covers the button of the concrete anchor and the tube is configured to enclose a portion of a tendon extending from the button.

22. The cover of claim 21 wherein the tube includes an annular ridge extending radially inward.

23. The cover of claim 20 wherein the second cover portion includes a nose housing having an aperture therethrough, the aperture being aligned with the axis.

24. The cover of claim 23, further including a removable cap adapted to mechanically engage the second cover portion and to close the aperture when engaged.

25. The cover of claim 19 wherein at least one of the first and second cover portions includes a sealing member configured to form a seal between the cover and the concrete anchor when the first and second cover portions are coupled by the at least one latch.

26. The cover of claim 25 wherein each of the first and second cover portions includes a sealing member and a groove for receiving the sealing member.

27. The cover of claim 19 wherein the first cover portion and the second cover portion are formed as separate components and wherein the at least one latch comprises at least one retainer extending from one of the first and second cover portions, wherein the flange includes a hole therethrough, the location of the hole corresponding to the location of the at least one retainer, and wherein the first and second cover portions are coupled by passing the at least one retainer through the hole in the flange and engaging the other of the first and second cover portions with the retainer.

* * * * *